United States Patent [19]

Clark

[11] Patent Number: 4,664,358

[45] Date of Patent: May 12, 1987

[54] FREE STANDING WALL STRUCTURES

[76] Inventor: Erin C. Clark, 7 Samoa St., Kilbirnie, Wellington, New Zealand

[21] Appl. No.: 843,805

[22] Filed: Mar. 27, 1986

Related U.S. Application Data

[63] Continuation of Ser. No. 612,640, May 21, 1984, abandoned.

[30] Foreign Application Priority Data

May 27, 1983 [NZ] New Zealand ..... 204391

[51] Int. Cl.[4] ..... E02D 17/00; E04H 17/14

[52] U.S. Cl. ..... 256/19; 52/233; 405/273

[58] Field of Search ..... 405/273, 286, 272; 256/19, 59, 60, 65; 52/233

[56] References Cited

U.S. PATENT DOCUMENTS

| | | | |
|---|---|---|---|
| 1,215,537 | 2/1917 | Hyatt | 405/273 |
| 1,262,224 | 4/1918 | Melvin | 405/273 |
| 1,485,381 | 3/1924 | Evers | 405/273 |
| 1,500,119 | 7/1924 | Evers | 405/273 |
| 1,596,795 | 8/1926 | Nagel | 405/273 |
| 1,690,136 | 11/1928 | Shimek | 405/273 |
| 1,787,199 | 12/1930 | Huntoon . | |
| 2,034,851 | 3/1936 | Wichmann | 405/273 |
| 2,094,167 | 9/1937 | Evers | 405/273 |
| 2,365,397 | 12/1944 | Dickman | 52/233 X |
| 4,512,685 | 4/1985 | Hegle | 405/284 |

FOREIGN PATENT DOCUMENTS

| | | | |
|---|---|---|---|
| 0016353 | 2/1980 | European Pat. Off. . | |
| 031154 | 7/1981 | European Pat. Off. . | |
| 2714524 | 10/1978 | Fed. Rep. of Germany | 256/19 |
| 2817549 | 10/1979 | Fed. Rep. of Germany . | |
| 3034131 | 4/1982 | Fed. Rep. of Germany . | |
| 2421243 | 10/1979 | France . | |
| 81141 | 4/1979 | Luxembourg . | |
| 138830 | 5/1966 | New Zealand . | |

*Primary Examiner*—John E. Murtagh

*Attorney, Agent, or Firm*—Holman & Stern

[57] ABSTRACT

An acoustic barrier comprises a free standing wall structure having an exoskeletal framework of gravity interlocked components (preferably of timber) and a filling of the exoskeletal framework. Ideally the structure is tiered and is of substantially constant cross section in each tier, although provision is made to step it up or down to take account changes in the contour on which it is located.

3 Claims, 30 Drawing Figures

FIG I

FREE STANDING WALL STRUCTURES

This is a continuation of application Ser. No. 612,640, filed May 21, 1984, now abandoned.

This application relates to copending U.S. patent applications Ser. Nos. 639,484 filed Aug. 10, 1984, and Ser. No. 590,042 (Design) filed Mar. 15, 1984, now abandoned.

BACKGROUND OF THE INVENTION

1. Field of the Invention

The present invention relates to improvements in and/or relating to free standing wall structures, acoustic walls incorporating such structure and methods and means applicable thereto.

2. Description of the Prior Art

Since the coming of the freeway or motorway age, noise has been a constant problem insofar as inhabitants of nearby dwellings and buildings are concerned. It is known that sound can be reflected or absorbed and appropriate wall structures for this purpose have on occasions been erected alongside a freeway or motorway. Such structures however tend to be prohibitively expensive and accordingly are seldom used for that very reason.

It has recently been found that various timber types can be used in association with the ground or earth fill provided the timer has been appropriately treated. This raises therefore the prospect of providing an acoustic or other free standing wall structure using timber.

BRIEF SUMMARY OF THE INVENTION

It is an object of the present invention to provide a free-standing wall structure; and a method of producing it which will overcome the above mentioned problems.

Accordingly in one aspect the present invention may broadly be said to consist in a free standing wall structure having an exoskeletal framework of gravity interlocked components and a filling of the exoskeletal framework.

Preferably the components are formed in timber.

Preferably the filling is earth or the like fill.

Preferably the wall structure is tiered.

Preferably the timber components are modular i.e. provide modular lengths of the wall structure.

Preferably the module is 550 mm.

Preferably the timber components are selected from components substantially as hereinafter described with reference to the accompanying drawings.

Preferably the tiering of the building is such that the tiers get progressively more narrow adjacent the top.

Preferably there are two or three tiers.

Preferably at any length of the wall the cross-sectional periphery at that cross-section is substantially identical to a cross-sectional periphery elsewhere in the wall, the only significant difference being a stepping up or down of the wall to take into account the contour of the ground.

Preferably the wall structure is tiered and modular in the lengthwise direction and there can be a stepping up or stepping down of modular lengths relative to each other with the proviso that where there is a stepping up or stepping down there is as a consequence of the tiering a width change zone over a zone beginning and ending some way up the wall, and at the interface between the modular lengths, while there are or can be stretchers or the like members that run beyond one modular length to another, such running beyond one length into another does not occur at the interface between the modular lengths within said width change zone.

Preferably a footing is provided. Preferably said footing is of concrete located timber forming part of the exoskeletal framework.

In a further aspect the present invention may broadly be said to consist in a method of forming an acoustic barrier wall which comprises a free standing wall structure having an exoskeletal framework of gravity interlocked (preferably timber) components and a filling of the exoskeletal framework, said method comprising providing a footing which includes at least some timber components of the exoskeletal framework, locating thereon components of a first tier of the framework over a length of the wall, locating components of a second tier on at least part of the first tier and subsequently locating components of a third tier on at least part of the second tier, and as convenient filling with fill the exoskeleton substantially to the level it has reached during and/or after such erection of the exoskeleton.

Preferably the structure is erected so that each wall is a repetition of modular lengths of the structure in a manner substantially as hereinafter described.

Preferably the method results in a free standing wall structure in accordance with the present invention.

In yet a further aspect the present invention may broadly be said to consist in kitset form components for a free standing wall structure in accordance with the present invention and/or for use in a method in accordance with the present invention.

BRIEF DESCRIPTION OF SEVERAL VIEWS OF THE DRAWINGS

Preferred forms of the present invention will now be described with reference to the accompanying drawings wherein:

FIGS. 6A to 6H are elevational views showing various components preferably all of the same thickness, FIG. 6A showing by way of example, a 1.2 meter stretcher, FIG. 6B showing a 2.4 meter stretcher, FIG. 6C showing a 1.2 meter header, FIG. 6D showing a 0.9 meter header, FIG. 6E showing a 0.6 meter header, FIG. 6F showing a 1.5 meter stretcher, FIG. 6G showing a 0.9 meter stretcher and FIG. 6H showing a keyblock;

FIGS. 8A to 8K are elevational views showing an array of preferred components for a 550 mm modular free standing timber structure, the components being, FIG. 8A a 1100 mm stretcher or runner, FIG. 8B a 825 mm stretcher, FIG. 8C a 2200 mm stretcher or runner, FIG. 8D a 1100 mm header of standard configuration, FIG. 8E a doubly notched header of 1100 mm lengths not having on the left hand side thereof those of the four notches not required but which can be provided to make erection more easy, there being shown to the left of FIG. 8*e* how if desired, the notching can be minimized.

FIG. 8F is a 825 mm header of normal configuration,

FIG. 8G is a header of 825 mm length, but of the double notch variety such as, for example, shown in FIG. 8E, FIG. 8H is a 733 header of standard configuration, FIG. 8I is a 550 mm header of standard configuration, FIG. 8J is a stretcher of 1375 mm length, and FIG. 8K is a key lock;

DETAILED DESCRIPTION

Figure 1:
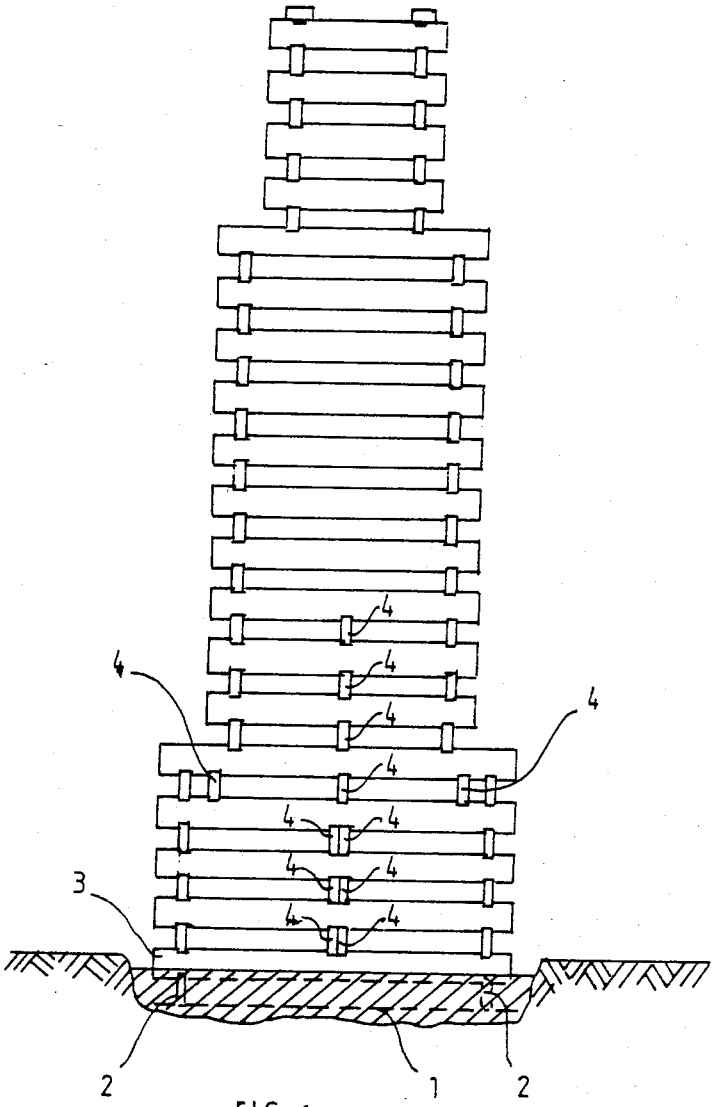
FIG. 1 is an end elevational view of a wall in accordance with the present invention having three tiers, the footing of the structure including timber sleeper and header like components appropriate for the first tier, such components being anchored in concrete.

In a first preferred from of the present invention, the timber chosen for economy is *pinus radiata* and the timber is preferably all of a constant cross-sectional area viz. 92 mm×36 mm. Preferably the timber has been ground treated with appropriate preservative. The preferred components are as depicted in FIGS. 6A to 6H and they are arranged as shown in the drawings.

With an acoustic wall having to follow the contours of the land and with the top of the wall needing to bear a substantially constant relationship to the freeway or motorway or other area being screened, especially for noise, the height of the wall should bear a constant relationship to the land as it extends there-across. There is the prospect of making incremental changes but in the preferred form of the present invention each section of wall is built substantially horizontal with steps up and/or down at various positions therealong being used to provide the staggering of the wall to take into account the changes in the contour.

Figure 7:
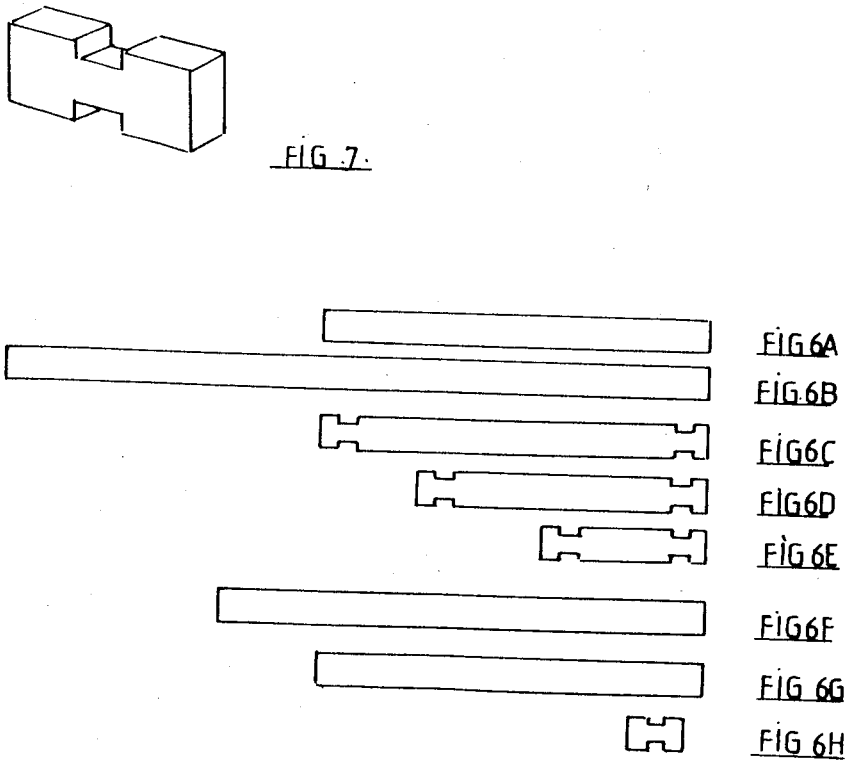
FIG. 7 is a perspective view of a keyblock.

As can best be seen in FIG. 1 ideally the ground is excavated and sleepers 1 provided. Stretchers 2 e.g. as in FIGS. 6A, 6B, 6F or 6G would then be positioned and on to which stretchers a first header 3 such as depicted in FIG. 6C would be positioned. That structure would then be located in concrete which is shown by the cross hatching. Thereafter the wall would be erected substantially as shown with headers extending across FIG. 1 and with stretchers extending into and out of the plane of the drawing. Header support blocks as depicted in FIGS. 6H and 7 are employed to provide the requisite stability for the structure and, so that they can be distinguished easily from the stretchers, are all indicated in FIG. 1 by reference numeral 4.

Figure 3:
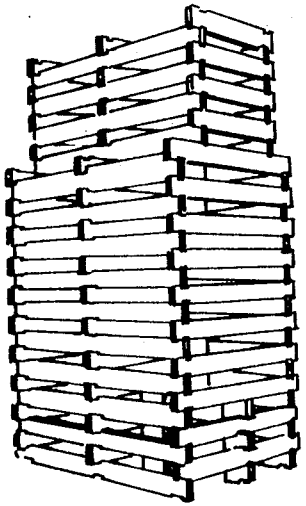
FIG. 3 is a pespective view of a short section of a free standing wall (there being no fill shown) over a short length thereof.

As can be seen therefore from FIG. 1 and indeed FIG. 3 the structure is gravity interlocked employing stretchers which do not include any cross-sectional modification and header support blocks which interlock with the headers substantially as depicted. It is envisaged that as the structure is progressively erected fill, in the form of earth, would be added to provide the bulk desired. Ideally the fill would be dropped in as each tier is completed.

FIG. 3 shows a very short length of wall in accordance with the present invention. From this it can be seen just how simple in the preferred form of the present invention the construction is. It is to be noted that the header support blocks are only needed down at the lower reaches where the loading on the headers is greatest.

Figure 2:
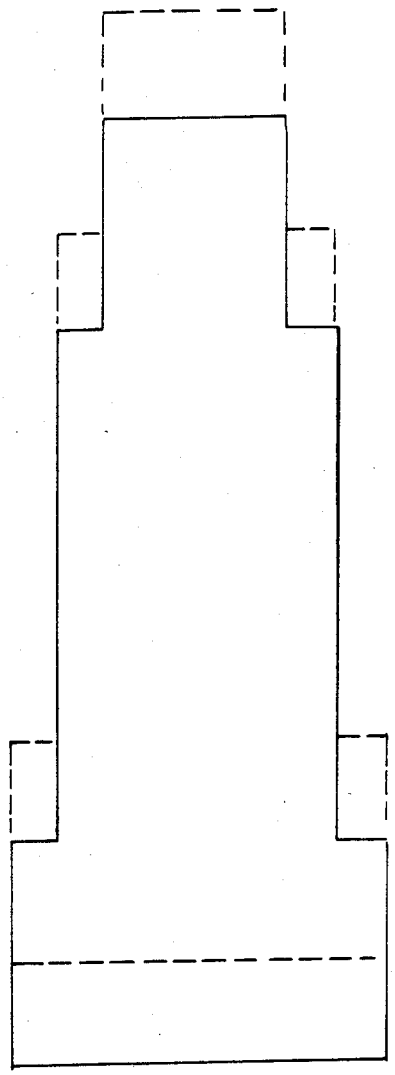
FIG. 2 shows schematically how the cross-sectional periphery will appear in solid outline at any particular position although the dotted modification thereof shows how that periphery might relate to, for example, a periphery at some distance along the length of the free standing wall owing to a stepping up or stepping down (which can be to any extent) to take into account the changes in the contour of the land over which continuous wall structure extends.
Figure 4:
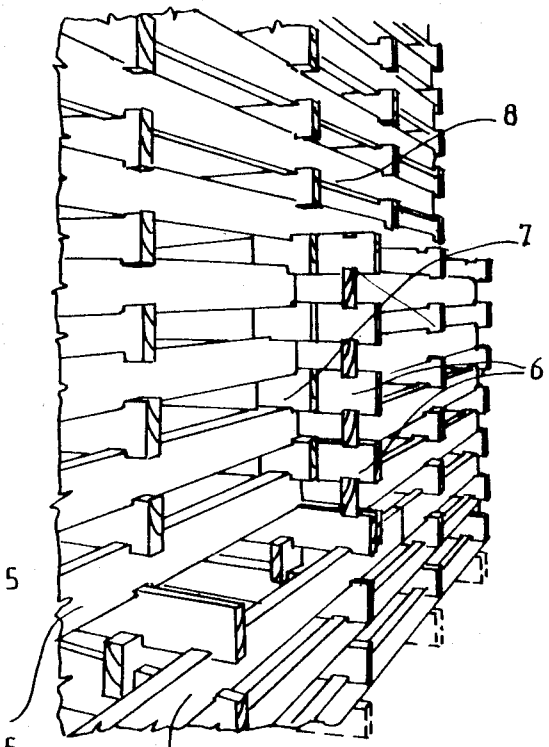
FIG. 4 is a perspective view along a wall in accordance with the present invention showing how by the use of appropriate headers, runners, keyblocks and the like different lengths of constant cross-section wall can be stepped against a similar cross-section.
Figure 5:
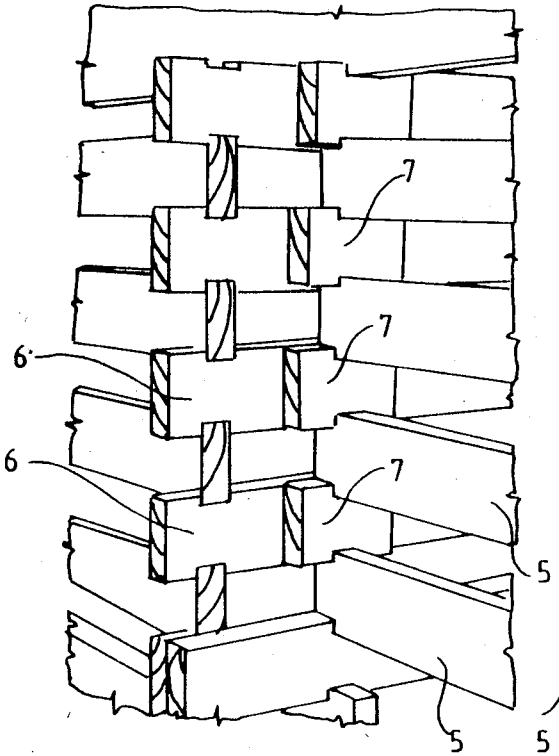
FIG. 5 is a view similar to FIG. 4 showing how in order to maintain the modularity of the system, if constant runners etc., are to be used a slight rearrangement of the lapping between the different sections of the wall is necessary using keyblocks.

A complication arises at the stepping interface of sections of wall such as depicted in FIG. 3. Obviously a section of wall can extend significantly longer preferably usually the longer stretcher members to provide a better tying of the structure together. However at some stage an interface subtantially as depicted in FIGS. 4 and 5 is necessary. Since it is desired to maintain the modularity between the wall sections and obviously with some stepping up or down as depicted in FIG. 2 in some positions at the interface there will be stretchers extending straight through but at a different vertical position stretchers must terminate short of the next section since there is a stepping up of the tiers of the next section at that point. It is therefore important that stretches 5 do not rest on the headers 6 because if they were to so the modularity of the system would be lost. Accordingly key members or header support blocks such as previously referred to are positioned at 7 so that the ends of the stretcher 5 can rest thereon and maintain the modularity of the system. Obviously however where there is a position such as, for example with stretcher 8, a stretcher should extend through the interface so as to better tie the whole structure together.

Figure 10:
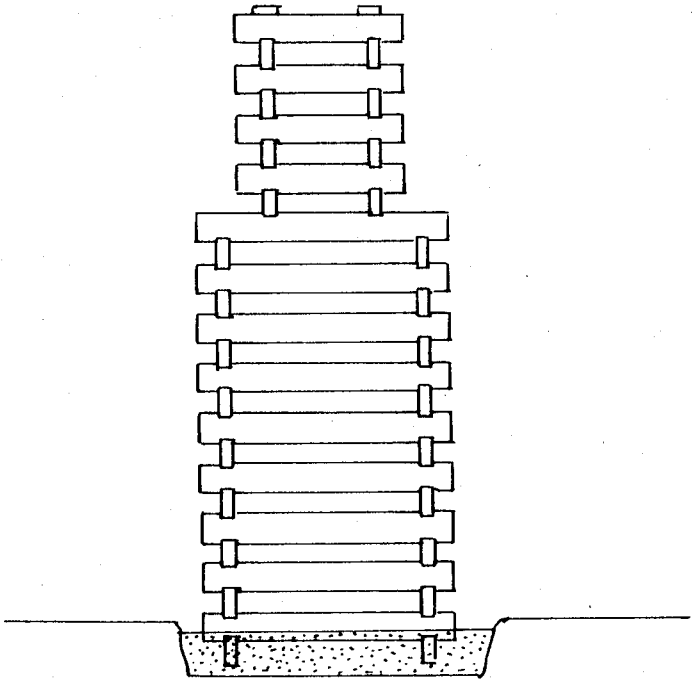
FIG. 10 view similar to that of FIG. 9 but of an alternative cross sectional dimensioned two tier structure i.e. one where the lower tier is of height 131 mm above ground level (and it is of a width of 825 mm) and has the second tier extending 200 mm above ground level (and of a width of 550 mm) and which uses, in a manner analogous to that of the structure in FIG. 9, headers shown in FIGS. 8F and 8I and, if there is longitudinal stepping, as shown in FIG. 8G.
Figures 8A, 8B, 8C, 8D, 8E, 8F, 8G, 8H, 8J, 8K:
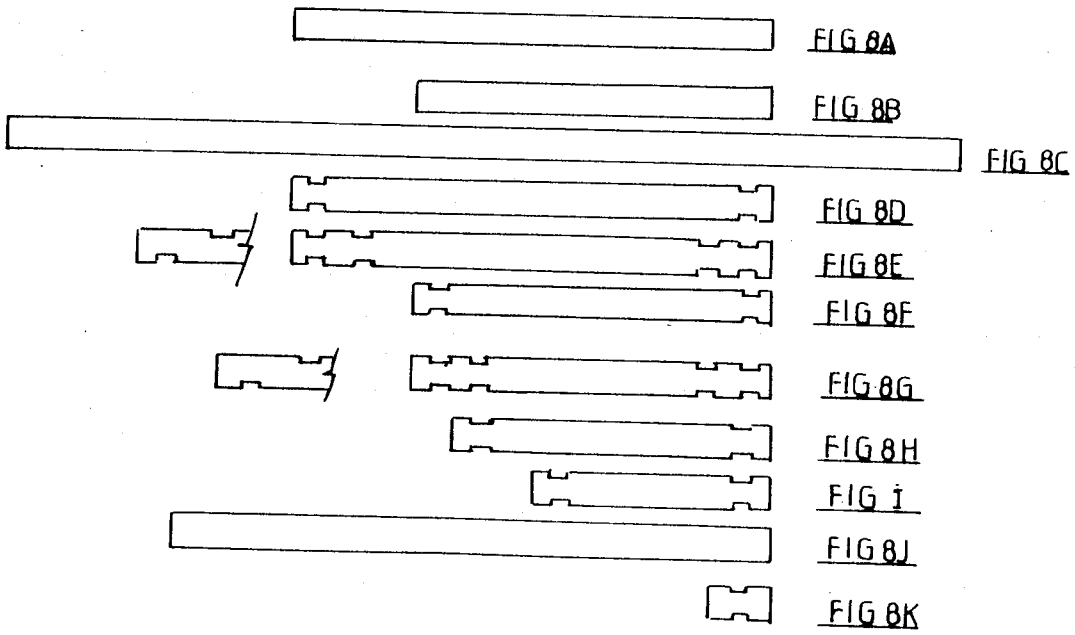
Figure 13:
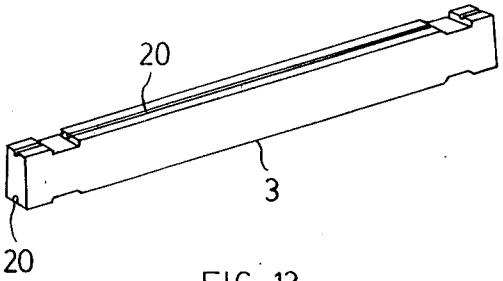
FIG. 13 is a perspective view showing a header embodiment having longitudinal grooves on opposite edges.
Figure 12:
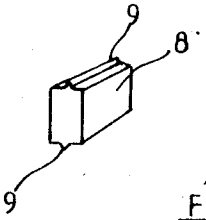
FIG. 12 shows the form of a modified header support block capable of being aligned longitudinally and located between appropriately grooved headers, such header support blocks being shown in FIG. 9 by way of example.
Figure 9:
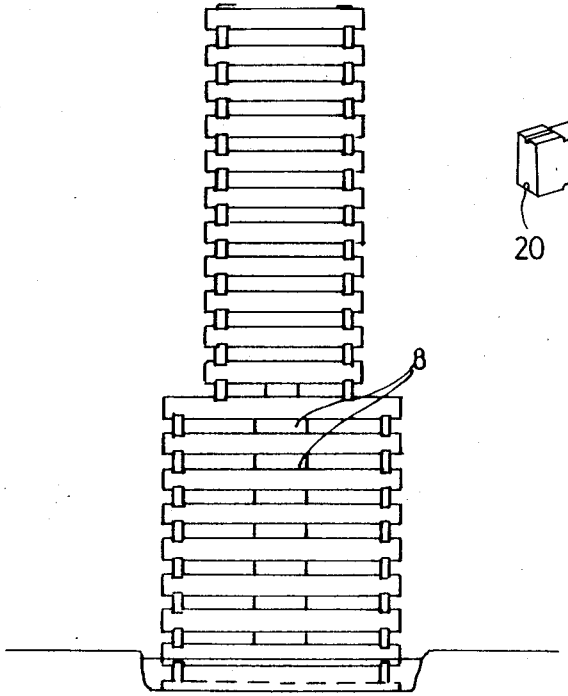
FIG. 9 is an end elevational view of a preferred two tier form of structure in accordance with the present invention showing a sleeper type arrangement set in concrete and showing how the structure can be configured, the structure of FIG. 9 having a first stage of 1100 mm width which extends 1150 mm above ground level, and a second tier of 733 mm width which extends to a full height of 3000 mm from ground level i.e. uses headers shown in FIGS. 8D and 8H and additionally 8E if there is stepping of the structure longitudinally.

In the more preferred form of the present invention the free standing wall structure is formed of the components shown in FIGS. 8A to 8K and are configured in a two tier construction as shown in FIG. 9 and 10. Referring specifically to FIG. 9 it can be seen that the arrangement is substantially as previously described except however, a two tier structure is involved and, if desired, a header support block 8 can be located by virtue of its ridges or ribs 9 in appropriate longitudinal grooves (20) which can be cut into the headers.

With the arrangements as shown in FIGS. 9 and 10 it is desirable that the preferred timber components (100×40 mm in cross section) be appropriately prepared. It is desirable that the backfill that is used comprises course granular material with an internal angle of friction of less than or equal to 35 degrees and of an inplace density of less than or equal to 1800 kg/cubic meter. Preferably in terms of shear strength the ultimate bearing capacity of the founding subgrade is required to be 70 kPa. The flexible nature of the wall enables it to withstand minor settlements without distress but large differential settlements, which could result in tilting or excessive bending in the stretch components, are best avoided.

Figure 11:
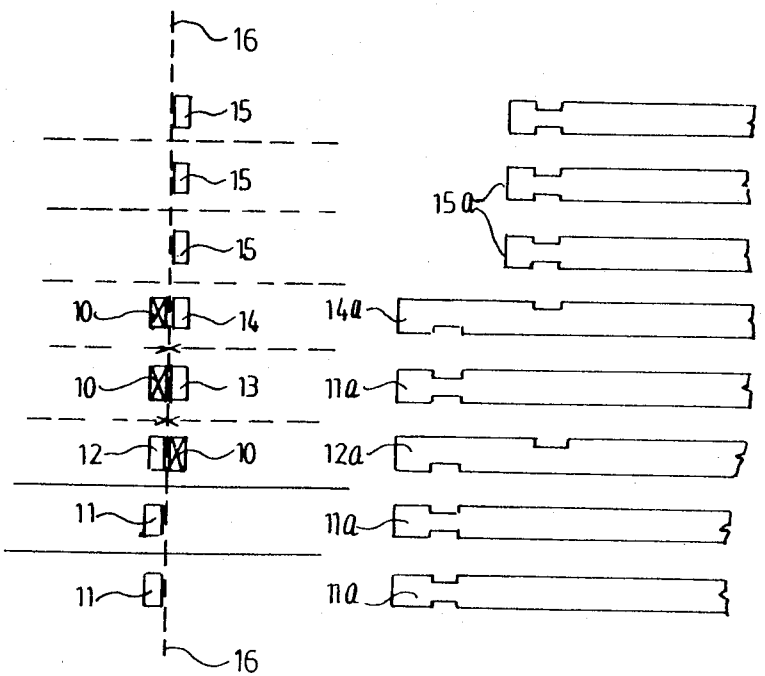
FIG. 11 is a diagrammatic view seeking to explain the nature of stepping by showing an end view of rectangular headers of notched configuration as shown to the right, and an end view of three key blocks (crossed ends), the solid lines between the various rectangular shapes showing the expanse of stretchers at the wider extremity while the dotted lines show the expanse of stretchers of the more narrow extremity, it being seen that there is a center line at which the modular length interfaces and beyond which center line, over the zone which corresponds to the stepping, the stretchers do not extend beyond—such ends of the stretchers being supported, as the case might be, on one of the header configurations or a key block.

The nature of a stepping interface between modular lengths of the wall (e.g. 550 mm module) will now be described. FIG. 11 attempts to show diagrammatically the manner in which the stepping can be achieved without loss of modularity. Firstly, it should be appreciated that the modular distance is not necessarily from center of a header to a center of the header. While this is so, in relation to headers away from the end headers of a length of wall structure, the modular distance is maintained between an end header and the next header to the end header from the outside face to the middle of the intermost of the two headers respectively. This however does not upset the erection of a structure while maintaining modularity.

Turning to FIG. 11 there can be seen by way of example that stepping up of "two" stretcher plus header heights is being achieved. It can be seen that there is provided a vertical center line 16 which over the adjustment zone has a header on one side and a key block on the other side. In FIG. 11 the key blocks 10 are shown with a crossed end. Inside of the stepping zone, i.e. where there is the actual change in thickness, (e.g. as best seen by way of illustration in FIGS. 4 and 5 in relation to the embodiment of FIG. 1) no stretcher extends beyond the center line 16. Outside of the zone the stretchers do extend through and beyond the center line 9. To assist in gauging the position of such stretchers (in relation to the plane of the sheet of the drawing) those shown in broken lines are at a more inward position than those shown in solid outline. Hence those shown in solid outline are stretchers at the outer regions of the lower tier while those shown in broken outline are those at an extremity of the upper tier. Hence the structure steps upwardly from the left hand side of the center line 16 to the right hand thereof. The rectangular portions 11 shows a header of end configuration as shown in 11*a* (i.e. a stretcher as shown in, for example, FIG. 8F), stretcher 12 is a stretcher 12*a* (substantially as shown in FIG. 8G either of the two options shown), headers 13 or header 13 is of configuration 11*a*, but of course its position is to the right hand side of the center line 16 against a key block 10 (such key block being shown in FIG. 8K). The next uppermost header 14 is of configuration 14*a* which is substantially identical, if not identical, to 12*a*. The headers 15 thereabove positioned to the right, but against the center line 16 are of configuration 15*a*, which by way of example, would be those shown in FIG. 8I.

It should be realized that while any one header 13 and mating key block ten has been shown, about six of those headers 13 each with a key block 10 on the other side of the center line 16 could be spaced one above the other (together with intermediary stretcher ends) in lieu of the single one shown, but thereby achieving a stepping up of approximately one meter from one modular length to the other.

A person skilled in the art will appreciate therefore how the stepping occurs and how over the thickness varying zone between modular lengths of the structure (the zone being limited between vertical extent to which are not at the limit of the structure can be provided with the component shown in FIG. 8A through to FIG. 8K without a loss of modularity.

On the basis of the foregoing therefore it can be seen that relatively simple components can be provided in appropriate ratios to allow the speedy and easy erection of a free standing wall of indefinite lengths. The exoskeletal nature of the wall allows for the easy filling thereof by simply dropping the fill down into the top of the wall as it is being erected or after it has been erected.

With the use of the components therefore of the present invention in the manner described it is believed that economical wall structures can be provided which provide adequate acoustic barrier properties and which of course will tend to be more aesthetic than conventional concrete structures since if desired, planting of the wall can take place.

I claim:

1. In a free standing longitudinal acoustical barrier wall structure constructed on a supporting surface and having an exoskeletal framework of interlocked components and a filling in the exoskeletal framework, the improvement wherein:

said exoskeletal framework comprises a plurality of peripheral wall forming wooden headers having a substantially rectangular cross-section and wooden stretchers the top and bottom sides substantially vertically stacked in interlocked relationship, pairs of stretcher locating notches on the top and bottom sides of and extending transversely across the entire width of said headers adjacent the ends thereof, said stretchers engaging in said notches on adjacent headers above and below each stretcher except the top and bottom stretcher in a manner to form a substantially rectangular cross-section framework;

longitudinal grooves extend along the top and bottom sides of said headers;

said wall structure is comprised of longitudinally connected modules comprised of said exoskeletal frameworks stepped up or down to conform to the contour of the surface on which the wall is constructed to form an interface between adjacent modules;

said wall structure is tiered, each tier comprising a plurality of said adjacent headers and a plurality of said stretchers disposed in adjacent relationship forming side walls, so that the width of said framework descreases with each tier, the cross-section within each tier being constant throughout the height thereof;

elongated header support blocks each having a substantially constant rectangular cross-section and top and bottom sides are interposed between at least the adjacent lower headers of the lowermost tier at a position between said stretcher locating notches and the associated stretchers to distribute the load on said lowermost headers carried by said stretchers, each header support block having ribs extending along the top and bottom sides thereof substantially conforming to and engaging in said longitudinal grooves of adjacent headers between said stretcher locating notches thereof; and said stepping up or down produces a change zone of the width at the tiering over a number of zones up the wall at each interface between adjacent modules so that stretchers that run beyond one modular length to another module do not occur at said interface between adjacent modules within said width change zone.

2. A free standing wall structure as claimed in claim 1 wherein:

the lowermost stretchers and headers are supported in a concrete footing.

3. A free standing wall structure as claimed in claim 1 wherein the filling of the exoskeletal framework comprises fill.

* * * * *